US005154229A

United States Patent [19]

Moonert et al.

[11] Patent Number: 5,154,229

[45] Date of Patent: Oct. 13, 1992

[54] CORE BOX HANDLING APPARATUS FOR A CORE MOLDING

[75] Inventors: Donald F. Moonert, Somonauk; Clyde Eicher, Naperville; Pheroze J. Nagarwalla, St. Charles; Raymond F. Witte, Romeoville, all of Ill.

[73] Assignee: Disamatic, Inc., Oswego, Ill.

[21] Appl. No.: 639,042

[22] Filed: Jan. 9, 1991

[51] Int. Cl.[5] ..... B22C 17/08

[52] U.S. Cl. ..... 164/183; 164/186; 164/201

[58] Field of Search ..... 164/186, 228, 201, 200, 164/202, 183

[56] References Cited

U.S. PATENT DOCUMENTS

| | | | |
|---|---|---|---|
| 3,482,619 | 12/1969 | Hulslander | 164/186 X |
| 3,520,347 | 7/1970 | Von Wolff et al. | 164/183 |
| 3,528,481 | 9/1970 | Lund | 164/200 X |
| 3,627,022 | 12/1971 | Shields | 164/183 X |
| 3,939,899 | 2/1976 | Kawai | 164/186 X |
| 4,436,141 | 3/1984 | Arana Erana | 164/201 |

FOREIGN PATENT DOCUMENTS

| | | | |
|---|---|---|---|
| 2145522 | 3/1972 | Fed. Rep. of Germany | 164/183 |
| 507395 | 4/1976 | U.S.S.R. | 164/186 |

*Primary Examiner*—J. Reed Batten, Jr.

*Attorney, Agent, or Firm*—Marshall, O'Toole, Gerstein, Murray & Bicknell

[57] ABSTRACT

A handling apparatus for a core molding machine is capable of moving a core box portion between a molding position and an eject position using only a single actuator. A carriage carries a platen that supports a core box portion wherein the platen is rotatable about a pivot axis relative to the carriage. The platen carries a roller that rolls on a cam surface adjacent the carriage. As the carriage is retracted away from a molding position, the roller rolls over the cam surface and permits the platen to pivot relative to the carriage downwardly toward the eject position.

12 Claims, 6 Drawing Sheets

CORE BOX HANDLING APPARATUS FOR A CORE MOLDING

TECHNICAL FIELD

The present invention relates generally to core molding machines, and more particularly to an apparatus for handling a core box of such a machine.

BACKGROUND ART

Core making machines are employed to produce sand cores that are in turn used to produce voids or recesses in cast parts. Such molding machines typically inject molding sand into a core box comprising first and second mating core box halves. In such machines adapted to accommodate core boxes having a vertical parting line, it is necessary to transport the assembled core box into the machine, clamp the core box halves together using side platens and inject molding sand into the core box. Following curing of the cores in the box, the side platens and core box halves are moved away from one another. Ejector pins carried by one of the side platens and extending through the corresponding core box half carried thereby ensure that the produced cores are retained within the other core box half. The platen carrying the other core box half is retracted by a first piston and cylinder unit and is tilted downwardly by a second piston and cylinder unit. The produced cores are then ejected onto a conveyor or other surface for further processing.

The above-described core box handling apparatus is unduly complicated owing to the use of separate piston and cylinder units for retracting the platen and tilting the platen downwardly. In addition to increasing the overall expense of the core making machine, valving must be provided for controlling two piston and cylinder units. Also, complicated linkages must be employed to effect such movement of the platen. Undesirable complexity thus results.

SUMMARY OF THE INVENTION

In accordance with the present invention, a handling apparatus handles a core box portion in a simple and efficient manner.

More particularly, a handling apparatus for a core molding machine includes a carriage movable between a molding position and an eject position along a linear path, a platen carried by the carriage and capable of supporting a portion of a core box wherein the platen is rotatable about a pivot axis transverse to the linear path and a cam surface adjacent the carriage. A cam follower is carried by the carriage and is disposed in contact with the cam surface wherein the cam surface and the cam follower resist rotation of the platen about the pivot axis when the carriage is in the molding position and permit rotation of the platen about the pivot axis as the carriage moves away from the molding position and toward the eject position.

Preferably, the cam follower comprises a roller rotatable on the cam surface. Also in accordance with a preferred form of the invention, the handling apparatus further includes an additional cam surface adjacent the carriage and an additional cam follower carried by the carriage and disposed in contact with the additional cam surface. The first-named cam surface is preferably disposed adjacent a first side of the carriage and the additional cam surface is preferably disposed adjacent a second side of the carriage opposite the first side.

According to a specific aspect of the present invention, the cam surface includes a first linear portion which is contacted by the cam follower when the carriage is in the molding position and a curved portion contiguous to the linear portion which is contacted by the cam follower when the carriage is moving toward the eject position. The curved portion defines an upward path for the cam follower as the carriage moves toward the eject position whereby the platen rotates about the pivot axis and is disposed with a facing surface directed downwardly when the carriage is in the eject position.

An actuator may be provided for moving the carriage between the molding and eject positions. In the preferred embodiment, the actuator comprises a piston and cylinder unit.

According to a further aspect of the present invention, a tilt down apparatus for moving a core box portion between a molding position at which cores are produced in the core box portion and an eject position at which produced cores are ejected from the core box portion includes a carriage movable between the molding position and the eject position, a platen carried by the carriage for supporting the core box portion, the platen being rotatable about a pivot axis between an upward orientation and a downward orientation and a cam surface adjacent the carriage having a linear portion and a curved portion contiguous with the linear portion. An arm is carried by the carriage and a roller is mounted on the arm in rolling contact with the cam surface. The arm, roller and linear portion of the cam surface resist rotation of the platen about the pivot axis away from the upward orientation when the carriage is in the molding position. The roller rolls over the curved portion of the cam surface to permit rotation of the platen about the pivot axis toward the downward orientation as the carriage moves away from the molding position and toward the eject position.

The present invention permits rapid and efficient handling of cores disposed in a core box portion and requires only a single actuator to effect movement of the platen and tilting thereof. Efficiency is thereby increased and complexity and cost are decreased.

DESCRIPTION OF THE PREFERRED EMBODIMENTS

Figure 1:
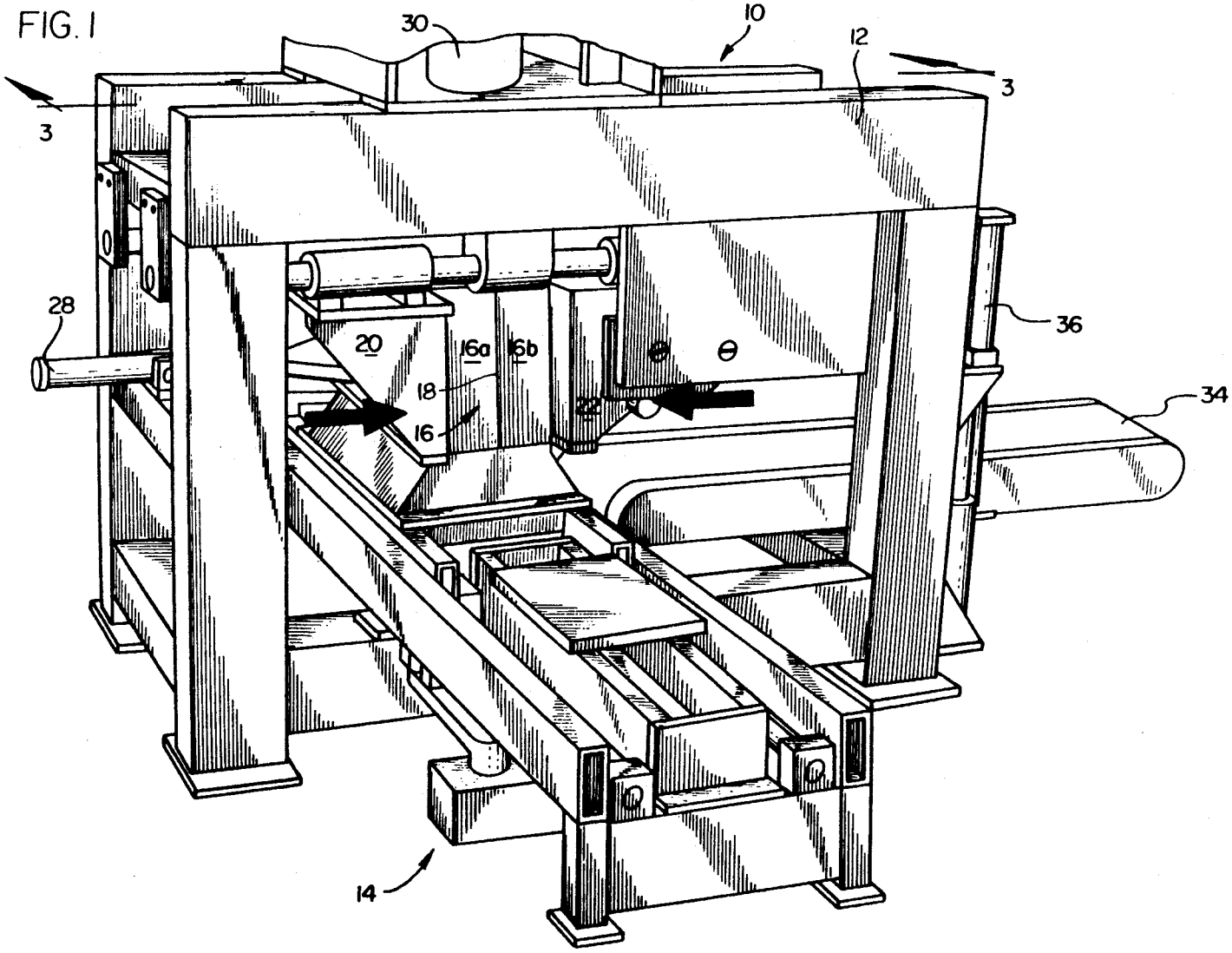
FIGS. 1 and 2 are perspective views illustrating a molding machine incorporating a handling apparatus according to the present invention during various stages of operation thereof.
Figure 2:
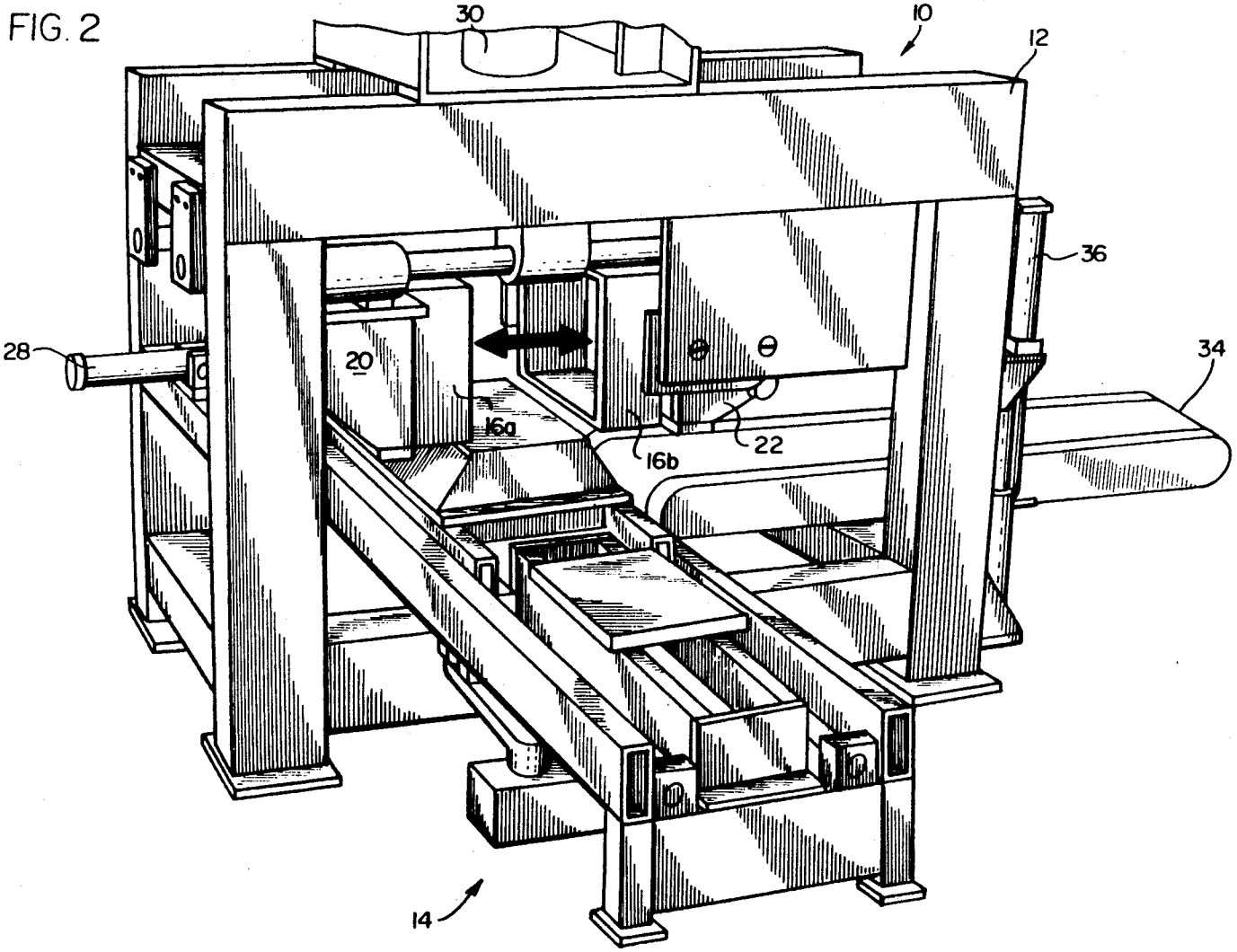
Figure 3:
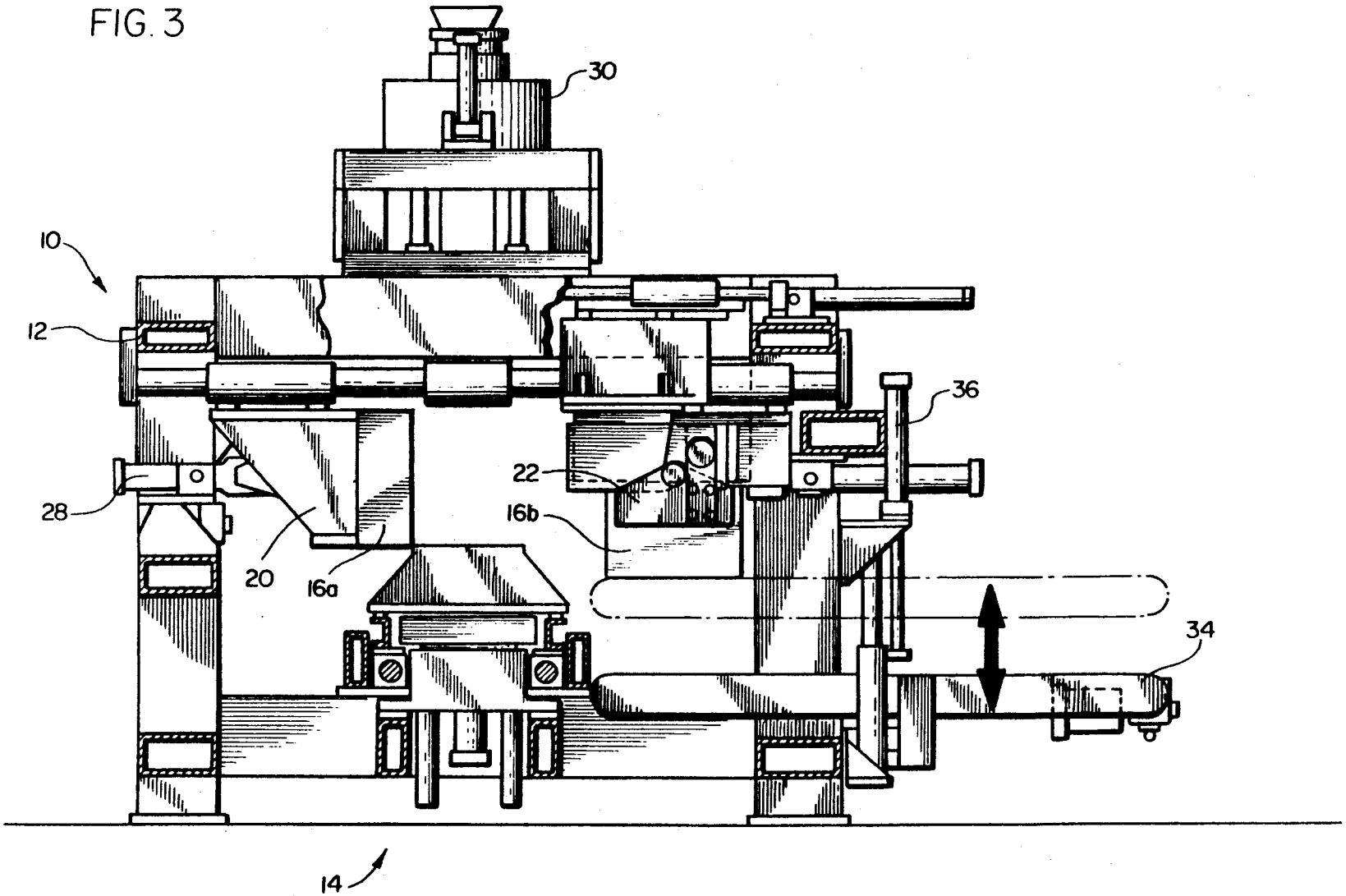
FIG. 3 comprises a sectional view taken generally along the lines 3—3 of FIG. 1 at a later stage of operation thereof.

Referring now to FIG. 1, a core molding machine 10 useful in the production of sand cores includes a frame 12 and a shuttle system 14 which transports a core box 16 toward and away from the machine 10. The core box 16 includes core box portions 16*a*, 16*b* which mate at a vertical parting line 18. When the core box is in the position shown in FIG. 1, a first or adjusting platen 20 and a second or tilting platen 22 are moved into engagement with the core box half portions 16*a*, 16*b*, respectively, and clamps (not shown) are operated to clamp the core box portions 16*a*, 16*b* to the platens 20, 22. Piston and cylinder units 26, 28 (only the piston and cylinder unit 28 is shown in FIGS. 1-3) are supplied working fluid to force the core box portions into tight mating engagement with one another. Thereafter, an extruding head 30 is moved into engagement with the core box 16 and molding sand is injected therein. The position of the adjusting platen during molding is controlled by a handwheel (not shown) and such position is maintained by the piston and cylinder unit 28 which has a larger cylinder diameter than the piston and cylinder unit 26. After injection, the extruding head 30 is moved away and a gassing plate (not shown) is moved into engagement with the core box 16. Curing gas of known composition is then injected into the core box to cure the molded cores.

Following the gassing operation, the gases in the core box 16 are exhausted and the gassing plate is moved away from the core box 16.

Referring to FIG. 2, following the foregoing steps, the cores are automatically removed from the core box portions 16*a*, 16*b*. More particularly, the tilting platen 22 is retracted so that the core box halves 16*a*, 16*b* separate. A spring loaded or pneumatically operated ejector system in the tilting platen 20 maintains the cores in the core box portion 16*b*. Inasmuch as the ejector system is immaterial to an understanding of the present invention, it will not be described in detail herein.

As the piston and cylinder unit 26 is operated to retract the tilting platen 22 from the molding position, the platen 22 and the corresponding core box portion 16*b* are tilted from an upward orientation to a downward orientation as seen in FIG. 3. A further ejector system then ejects the produced cores onto a conveyor 34 for further processing. Again, since the further ejector system is unimportant to an understanding of the present invention, it will not be described in detail herein. The conveyor 34 is movable upward and downward by means of an actuator in the form of a piston and cylinder unit 36. During tilting of the platen 22, the conveyor 34 is displaced downwardly to provide clearance for the core box portion 16*b* and the cores residing therein. The conveyor 34 is then raised so that the cores can be ejected and fall only a short distance onto the conveyor 34 to minimize the likelihood of breakage or damage to the cores.

After ejection of the cores onto the conveyor 34, the piston and cylinder unit 26 is operated to move the platen 22 and the core box portion 16*b* away from the eject position toward the molding position. During this movement, the conveyor 34 is lowered and the platen 22 is tilted upwardly from the downward orientation to the upward orientation. Production of additional cores may then be effected following the above-described sequence of steps.

FIGS. 4-9 illustrate a tilt-down apparatus 40 for moving the tilting platen 22 and the core box portion 16*b* in response to motive power supplied by the piston and cylinder unit 26. The tilt-down apparatus 40 includes a carriage 42 which is mounted by bearing blocks 44, 46 on guide rails 48, 50, respectively. The guide rails 48, 50 are supported by support plates 52 which are in turn mounted on the frame 12. The carriage 42 is movable between the molding position and the eject position along the guide rails 48, 50. The carriage includes a top plate 54 bolted to the bearing blocks 44, 46 and side plates 56, 58 welded thereto. Gussets 62, 64 are welded between the top plate 54 and the side plates 56, 58 to add rigidity to the carriage 42.

A bottom plate 66 extends between and is welded to the side plates 56, 58. The bottom plate 66 includes a hole 68 therein for mounting a clevis 70 secured to a piston rod 72 of the piston and cylinder unit 26. A pin extends through holes 74, 76 and the hole 68 in the bottom plate to mount the clevis 70, and hence the piston rod 72, to the bottom plate 66 and the rest of the carriage 42.

The piston and cylinder unit 26 is bolted to the frame 12 so that the unit 26 can move the carriage 42 relative to the frame 12.

A cross tie 80 extends between and is welded to the side plates 56 and 58. The cross tie 80 further adds structural rigidity to the carriage 42.

Figure 7:
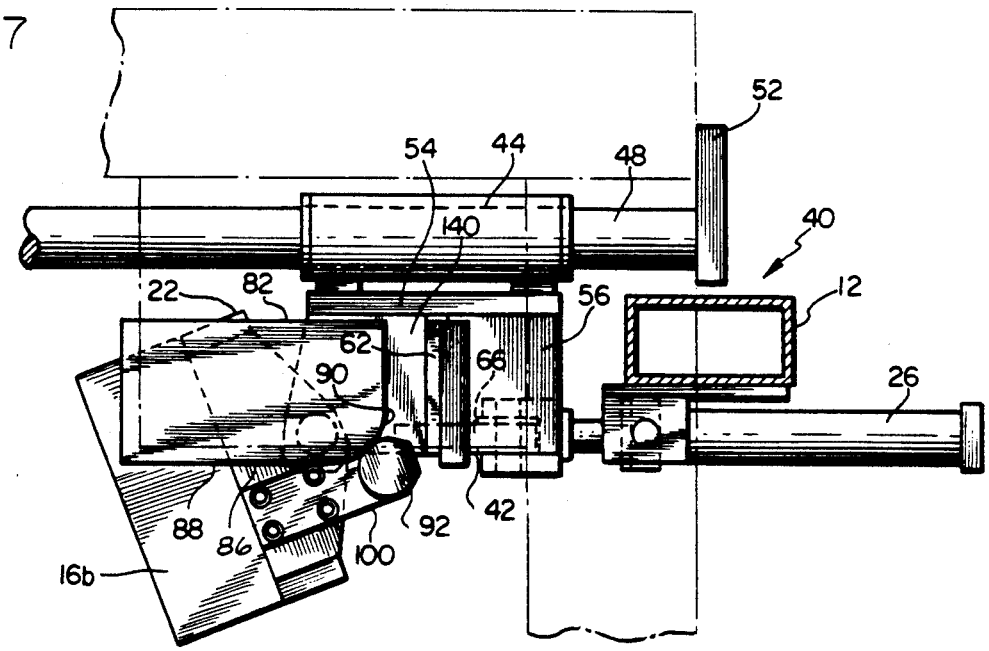
FIG. 7 comprises an elevational view taken generally along the lines 7—7 of FIG. 4.

Welded or otherwise secured to the frame 12 are first and second cam plates 82, 84. The cam plates 82, 84 are identical and hence only the cam plate 82 will be described in detail. Referring specifically to FIG. 7, the plate 82 includes a cam surface 86 having a first or linear portion 88 and a second or curved portion 90 contiguous therewith. As noted in greater detail hereinafter, at least one and preferably two cam followers comprising a first roller 92 and a second roller 94 are disposed in rolling contact with the cam surface 86 of the cam plate 82 and a corresponding cam surface 96 of the cam plate 84.

The first and second rollers 92, 94 are mounted by arms 100, 102 that are bolted to the tilting platen 22. As seen specifically in FIGS. 5, 6 and 9, the tilting platen includes top and bottom plates 103, 104, respectively, platen side plates 106, 108, platen stiffeners 110, 112 and a platen face plate 114, which are welded or otherwise fastened together. A series of support pins 116 are welded into apertures in the face plate 114 and extend forwardly of the face plate 114 into corresponding apertures in the core box portion 16*b*. The pins 116 assist in supporting the core box portion 16*b*.

Figure 4:
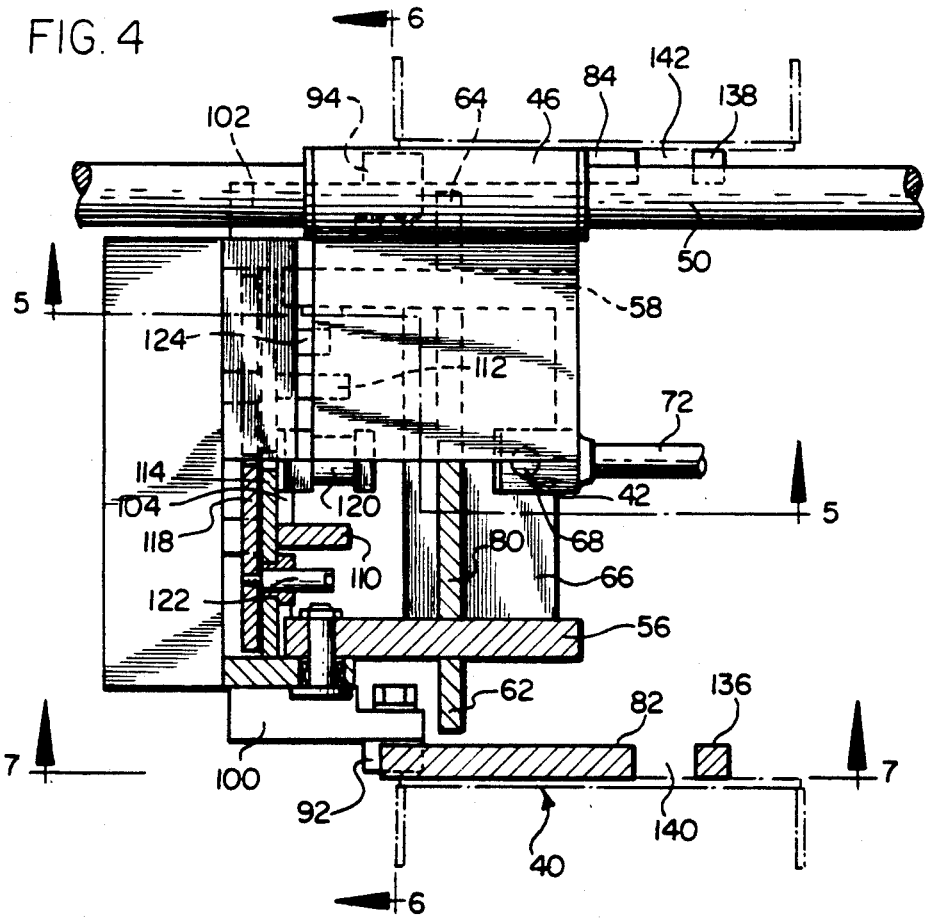
FIG. 4 comprises a partial sectional view taken generally along the lines 4—4 of FIG. 6 illustrating the handling apparatus of the present invention.
Figure 9:
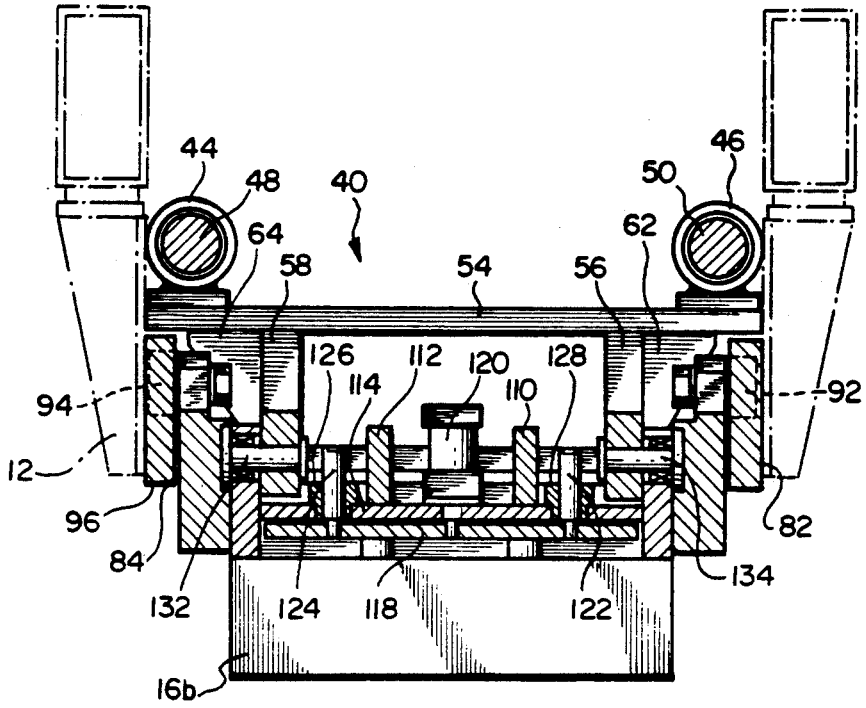
FIG. 9 is a partial sectional view taken generally along the lines 9—9 of FIG. 8.

Disposed forwardly of the face plate 114 is a movable ejector plate 118, best seen in FIGS. 4 and 9, which is movable by means of an actuator in the form of a ram 120 that is secured to the face plate 114. Guide rods 122, 124 are carried by the ejector plate 118 and extend through bushings 126, 128, respectively, which are in turn secured to the face plate 114. One or more vent tubes (not shown) may extend through the face plate to allow exhaust of curing gas from the core box 16.

Figure 6:
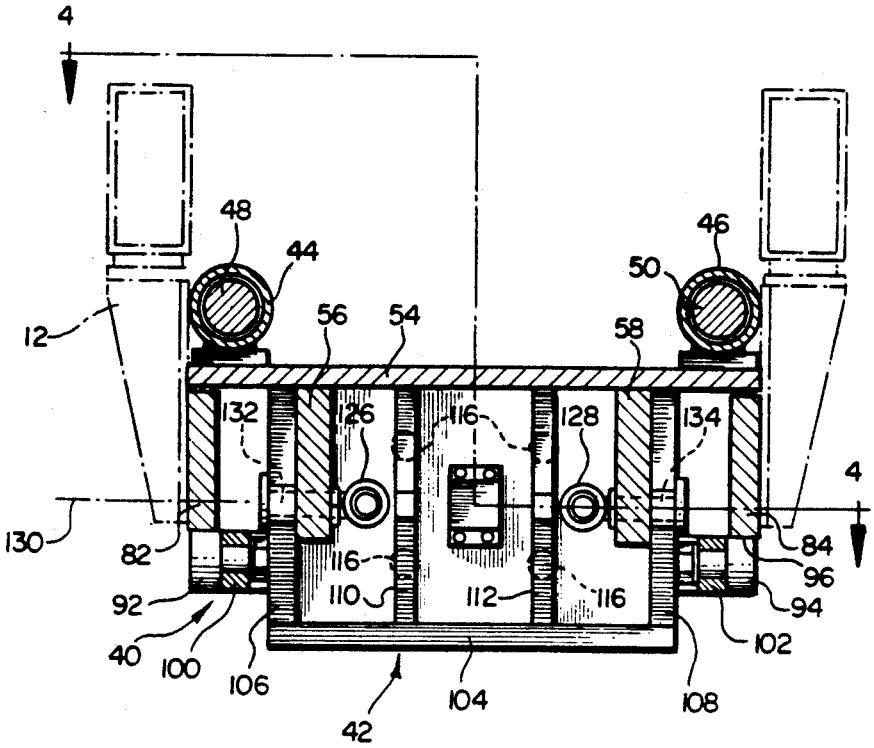
FIG. 6 comprises a sectional view taken generally along the lines 6—6 of FIG. 4.

The platen 22 is mounted for rotational movement about a pivot axis 130, FIG. 6, by means of first and second pins 132, 134 that extend through aligned apertures in the platen side plate 106 and a carriage side plate 56 and aligned apertures in the platen side plate 108 and the carriage side plate 58, respectively.

Figure 5:
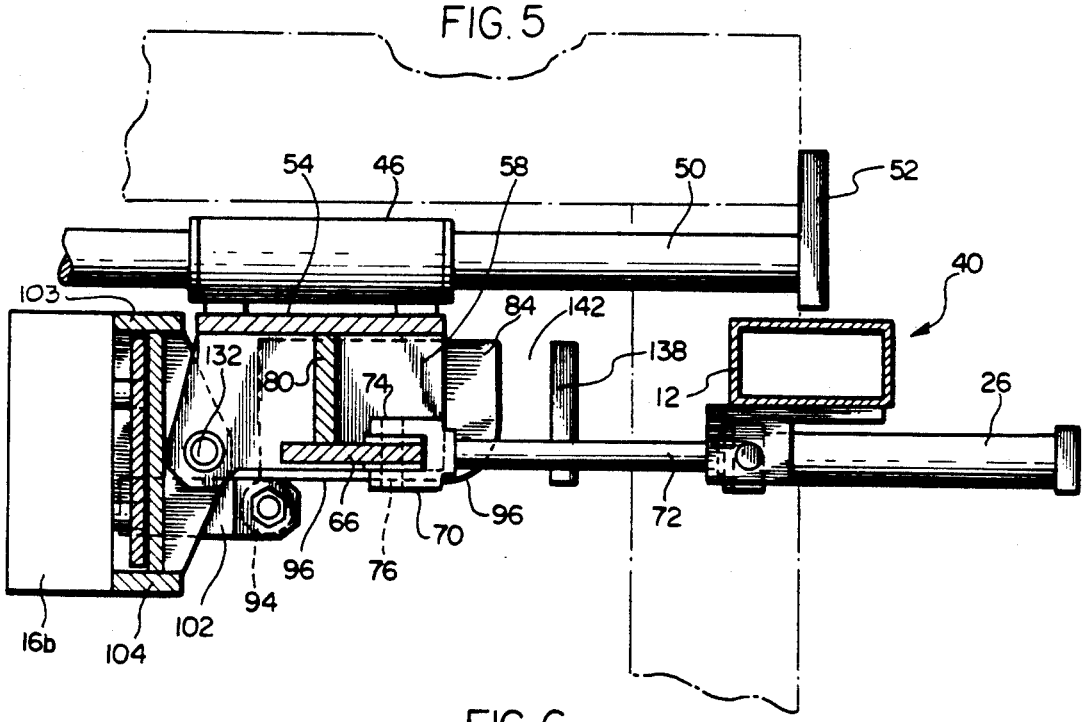
FIG. 5 comprises a sectional view taken generally along the lines 5—5 of FIG. 4.
Figure 8:
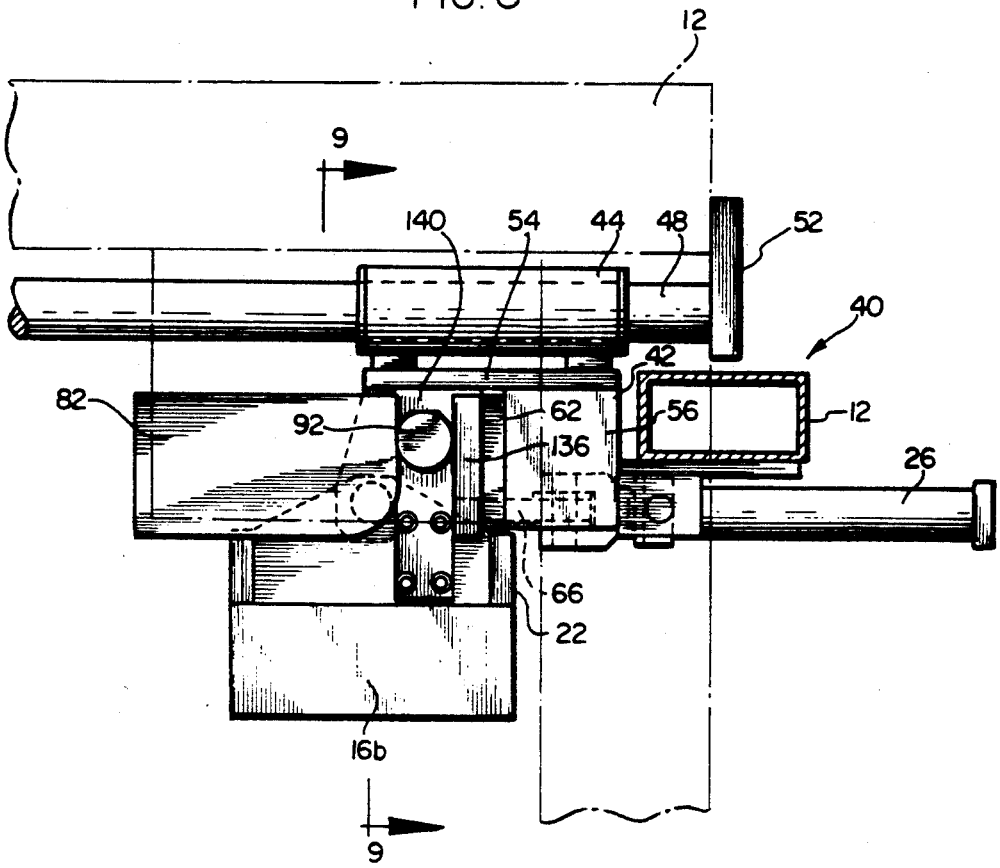
FIG. 8 is a view similar to FIG. 7 illustrating the platen in the downward position.

The sequence of operation of the handling apparatus is best described with reference to FIGS. 5, 7 and 8. Referring first to FIG. 5, and as noted previously, the platen 22 is in the upward orientation at the molding position when the piston and cylinder unit 26 is fully extended. In this position, rotation of the the platen 22 about the pivot axis 130 is prevented by the arms 100, 102, the rollers 92, 94 and the cam plates 82, 84. As the piston and cylinder unit 26 retracts the platen 22, the rollers 92, 94 ride over the linear portions of the cam surfaces 86, 96 until the rollers 92, 94 roll into contact with the curved portions of the cam surfaces 86, 96. The weight of the platen 22 and the core box portion **16*b* with cores therein causes the platen 22 to rotate about the axis 130 so that the rollers 92, 94 traverse an upward path and the core box 16*b* is tilted downwardly. Eventually, as seen in FIG. 8, continued retraction of the platen 22 results in the platen 22 assuming the downward orientation at the eject position. Stops 136, 138 are welded or otherwise secured to the frame 12 and, together with the cam plates 82, 84 define recesses 140, 142, respectively, within which the rollers 92, 94 are captured when the platen 22 is in the downward orientation to in turn prevent substantial rotation of the platen 22** when in the eject position.

The platen 22 is returned to the molding position by reversing the above-described sequence of steps. More particularly, extension of the platen 22 by the piston and cylinder unit 26 results in the rollers 92 rolling over the curved surfaces, in turn causing tilting of the platen 22 upwardly to the upward orientation. Continued extension of the platen 22 results in the platen 22 moving to the molding position as shown in FIG. 5.

The handling apparatus of the present invention requires only a single cylinder to retract and tilt the platen and core box supported thereby, resulting in a relatively low cost, simple and efficient core molding machine.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A handling apparatus for a core molding machine, comprising:

a carriage movable between a molding position and an eject position along a linear path;

a platen carried by the carriage and capable of supporting a portion of a core box, the platen being rotatable about a pivot axis transverse to the linear path;

a cam surface adjacent the carriage;

a cam follower carried by the carriage and disposed in contact with the cam surface, the cam surface and cam follower resisting rotation of the platen about the pivot axis when the carriage is in the molding position and permitting rotation of the platen about the pivot axis as the carriage moves away from the molding position and toward the eject position; and a single actuator for applying a force to the carriage to effectuate both translation of the carriage along the linear path and rotation of the platen about the pivot axis.

2. The handling apparatus of claim 1, wherein the cam follower comprises a roller rotatable on the cam surface.

3. The handling apparatus of claim 1, further including an additional cam surface adjacent the carriage and an additional cam follower carried by the carriage and disposed in contact with the additional cam surface.

4. The handling apparatus of claim 3, wherein the first-named cam surface is disposed adjacent a first side of the carriage and the additional cam surface is disposed adjacent a second side of the carriage opposite the first side.

5. The handling apparatus of claim 1, wherein the cam surface includes a first linear portion which is contacted by the cam follower when the carriage is in the molding position and a curved portion contiguous to the linear portion which is contacted by the cam follower when the carriage is moving toward the eject position.

6. The handling apparatus of claim 5, wherein the curved portion defines an upward path for the cam follower as the carriage moves toward the eject position whereby the platen rotates about the pivot axis and is disposed with a facing surface directed downwardly when the carriage is in the eject position.

7. The handling apparatus of claim 1, wherein the single actuator comprises a piston and cylinder unit.

8. A tilt-down apparatus for moving a core box portion between a molding position at which cores are produced in the core box portion and an eject position at which produced cores are ejected from the core box portion, comprising:

a carriage movable between the molding position and the eject position;

a platen carried by the carriage for supporting the core box portion, the platen being rotatable about a pivot axis between an upward orientation and a downward orientation;

a cam surface adjacent the carriage having a linear portion and a curve portion contiguous with the linear portion;

an arm carried by the carriage;

a roller mounted on the arm and disposed in rolling contact with the cam surface wherein the arm, roller and linear portion of the cam surface resist rotation of the platen about the pivot axis away from the upward orientation when the carriage is in the molding position and wherein the roller rolls over the curved portion of the cam surface to permit rotation of the platen about the pivot axis toward the downward orientation as the carriage moves away from the molding position and toward the eject position; and a single actuator for applying a force to the carriage to effectuate both translation of the carriage along a path and rotation of the platen about the pivot axis.

9. The tilt-down apparatus of claim 8, further including an additional cam surface adjacent the carriage, an additional arm carried by the carriage and an additional roller mounted on the additional arm and disposed in rolling contact with the additional cam surface.

10. The tilt-down apparatus of claim 9, wherein the first-named cam surface is disposed adjacent a first side of the carriage and the additional cam surface is disposed adjacent a second side of the carriage opposite the first side.

11. The tilt-down apparatus of claim 8, wherein the curved portion of the cam surface defines an upward path for the roller as the carriage moves toward the eject position whereby the platen rotates about the pivot axis and is disposed in the downward orientation when the carriage is in the eject position.

12. The tilt-down apparatus of claim 8, wherein the single actuator comprises a piston and cylinder unit.

* * * * *